US008097575B2

(12) United States Patent
Durrant

(10) Patent No.: US 8,097,575 B2
(45) Date of Patent: Jan. 17, 2012

(54) COMPOSITION AND METHOD FOR CLEANING AND NEUTRALIZING A SURFACE

(75) Inventor: Edward E. Durrant, Providence, UT (US)

(73) Assignee: Harris Research, Inc., Logan, UT (US)

( * ) Notice: Subject to any disclaimer, the term of this patent is extended or adjusted under 35 U.S.C. 154(b) by 1211 days.

(21) Appl. No.: 11/188,066

(22) Filed: Jul. 22, 2005

(65) Prior Publication Data

US 2006/0122091 A1 Jun. 8, 2006

Related U.S. Application Data

(60) Provisional application No. 60/632,871, filed on Dec. 2, 2004.

(51) Int. Cl.
*C11D 17/00* (2006.01)

(52) U.S. Cl. ..... 510/175; 252/174; 216/29; 216/83

(58) Field of Classification Search ..... 510/175; 252/174; 216/29, 83
See application file for complete search history.

(56) References Cited

U.S. PATENT DOCUMENTS

| | | | | |
|---|---|---|---|---|
| 2,606,165 | A * | 8/1952 | Chapin et al. | 524/277 |
| 3,865,756 | A | 2/1975 | Smith | |
| 3,972,839 | A * | 8/1976 | Murphy | 510/202 |
| 4,064,062 | A | 12/1977 | Yurko | |
| 4,219,333 | A | 8/1980 | Harris | |
| 4,447,567 | A | 5/1984 | Geerdes et al. | |
| 4,505,986 | A | 3/1985 | Geerdes et al. | |
| 4,619,711 | A | 10/1986 | Olbrueck et al. | |
| 4,643,840 | A | 2/1987 | Brocklehurst et al. | |
| 4,734,138 | A | 3/1988 | Ely et al. | |
| 4,867,853 | A | 9/1989 | Hauffe et al. | |
| 5,061,395 | A * | 10/1991 | Meng | 510/423 |
| 5,098,472 | A | 3/1992 | Watkins et al. | |
| 5,155,170 | A | 10/1992 | Baukema et al. | |
| 5,160,766 | A | 11/1992 | Waltrip et al. | |
| 5,221,359 | A | 6/1993 | Kaupert | |
| 5,244,468 | A | 9/1993 | Harris et al. | |
| 5,616,419 | A | 4/1997 | Hsu et al. | |
| 5,635,248 | A | 6/1997 | Hsu et al. | |
| 5,709,589 | A | 1/1998 | Boone | |
| 5,718,729 | A | 2/1998 | Harris | |
| 5,733,380 | A | 3/1998 | Murphy | |
| 5,733,666 | A | 3/1998 | Sinko | |
| 5,763,510 | A | 6/1998 | Janeway | |
| 5,859,135 | A | 1/1999 | Doomen et al. | |
| 6,017,872 | A * | 1/2000 | Pedersen et al. | 510/424 |
| 6,218,448 | B1 | 4/2001 | Kraaijevanger et al. | |
| 6,444,134 | B1 * | 9/2002 | Holman et al. | 216/29 |
| 6,461,676 | B2 | 10/2002 | Martino | |
| 6,479,151 | B2 | 11/2002 | Buter et al. | |
| 6,503,128 | B1 | 1/2003 | Deware et al. | |
| 6,759,378 | B2 | 7/2004 | Karlsson et al. | |
| 2001/0056137 | A1 | 12/2001 | Buter et al. | |
| 2003/0032571 | A1 * | 2/2003 | Olson et al. | 510/201 |
| 2003/0040562 | A1 | 2/2003 | West et al. | |
| 2003/0059639 | A1 | 3/2003 | Worsley | |
| 2003/0114327 | A1 | 6/2003 | Rehm et al. | |
| 2004/0002437 | A1 | 1/2004 | Wilson | |
| 2004/0005992 | A1 | 1/2004 | Ebberts | |

FOREIGN PATENT DOCUMENTS

| | | | |
|---|---|---|---|
| WO | WO 01/77202 | A1 | 10/2001 |
| WO | WO 02/074525 | A1 | 9/2002 |

* cited by examiner

*Primary Examiner* — Milton I Cano
*Assistant Examiner* — Mohammad Asdjodi
(74) *Attorney, Agent, or Firm* — Kunzler Needham Massey & Thorpe

(57) ABSTRACT

A method and new use of an aqueous composition including a surfactant and a buffering agent, wherein the new use and method include the steps of applying the composition to a surface with an acidic finish, etching the surface, and removing the aqueous composition. The removal may be by evaporation. A new finish may be applied to the surface. Methods are disclosed for the cleaning and neutralizing of an existing finish to allow for the application of a new finish. Also disclosed are compositions for the cleaning and neutralizing of an existing finish without complete removal of the existing finish. The compositions include a buffering agent configured to neutralize the existing finish, and a surfactant.

6 Claims, No Drawings

COMPOSITION AND METHOD FOR CLEANING AND NEUTRALIZING A SURFACE

This invention claims priority, under 35 U.S.C. §119, to the U.S. Provisional Patent Application Ser. No. 60/632,871, to Edward E. Durrant filed on Dec. 2, 2004, which is herein incorporated by reference.

BACKGROUND OF THE INVENTION

1. Field of the Invention

The present invention is directed to a method and a composition for cleaning and neutralizing a surface. Specifically, the present invention is directed to a method and composition for cleaning and neutralizing an acidic finished surface using a composition of a buffer and a surfactant.

2. Description of the Related Art

After time, finishes, such as clear coats, or other protective coatings applied to wood floors, oxidize and become acidic. Even if the finish is cleaned and etched, the acidic nature of the finish prevents proper application of a subsequent finish, such as a new coat of polyurethane. Specifically, a new coat of polyurethane finish applied to an acidic finish forms a slimy precipitate. The slimy precipitate, if allowed to cure, gives the surface an unattractive appearance. Further, if a new coat of finish is applied to an acidic finish, the new finish may delaminate from the surface.

Currently, the process of refinishing involves the steps of: 1) removing the old finish (typically by sanding or stripping), 2) if the removal of the old finish is performed by stripping, then the surface is neutralized, and 3) refinishing the surface. This process may require several days to complete.

A representative method of the prior art is illustrated in U.S. Pat. No. 4,734,138, which discloses a method for removing paints, stains, varnishes, and so forth comprising application of compositions consisting essentially of an aqueous solution of an alkali metal hydroxide, sodium bicarbonate, ethylene glycol, glycerol, and xanthan gum. The compositions are applied to the surface having the coating desired to be removed by brushing, spraying, and the like, allowed to stand for a time, then either wiped off or washed off with water, except in the case of creosote removal, where the composition is allowed to dry and then removed by conventional methods.

Another representative method of the prior art is illustrated in U.S. Pat. No. 6,444,134, which discloses a method for finishing a wood floor. The method comprises a first step of applying an aqueous polar solvent for a sufficient period of time to allow removal of a portion of any existing stains and soils and to at least partially etch the surface of an existing finish. The method also comprises a second step of applying an aqueous rinse to flush at least a substantial portion of any residue formed in the first steps and a third step of applying a water based finish and allowing it to dry.

The prior art systems may involve multiple components that are separately used on the floor and may be mistakenly used out of order. Further, a waiting period may be required in the first step, adding to the time required before reaching the third step of applying more finish to the floor. Further, typical prior art methods remove the entire existing finish on the surface, thus requiring the addition of a complete new finish to the surface.

What is needed is a composition and method for cleaning and neutralizing a surface that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available compositions and methods of preparing a finished surface for refinishing.

The present invention is directed to a method and a composition for cleaning and neutralizing a surface. Specifically, the present invention is directed to a method and composition for cleaning and neutralizing an acidic finished surface using a composition of a buffer and a surfactant.

Accordingly, one embodiment of the present invention includes a new use of an aqueous composition for preparing a surface comprising an acidic finish. The aqueous composition includes a surfactant, a buffering agent, and a pH of greater than the pH of the acidic finish. The new use comprises the steps of applying the aqueous composition to a surface comprising an acidic finish, etching the surface, and removing the aqueous composition from the surface. The new use may also include the step of applying a new finish to the surface. The step of removing the aqueous composition from the surface may include evaporation of the aqueous composition. The step of etching the surface may include use of a surface-working apparatus.

The buffering agent of the aqueous composition may include a weak base. The weak base may be selected from the group consisting of triethanolamine, ammonia, sodium tetraborate, sodium citrate, sodium carbonate, sodium bicarbonate, and mixtures thereof. The buffering agent may include an acid dissociation constant of from about 6.4 to about 10.3. The buffering agent may include triethanolamine. The composition may include from about 0.1 to about 1.0 volume percent of buffering agent, excluding the surfactant. The composition may include from about 0.1 to about 1.0 volume percent of surfactant, excluding the buffering agent.

In another embodiment, the invention includes a method of cleaning and neutralizing a surface having an acidic finish. The method comprises the steps of applying an aqueous composition to a surface, etching the surface and removing the aqueous composition from the surface. The aqueous composition may include a surfactant, a buffering agent, and a pH of greater than the pH of the acidic finish. The method may also include the step of applying a new finish to the etched surface. The step of etching the surface may include use of a surface-working apparatus.

The aqueous composition may include a buffering agent selected from the group consisting of triethanolamine, ammonia, sodium tetraborate, sodium citrate, sodium carbonate, sodium bicarbonate, and mixtures thereof. The buffering agent may include an acid dissociation constant of from about 6.4 to about 10.3. The buffering agent may include triethanolamine. The aqueous composition may include from about 0.1 to about 1.0 volume percent of buffering agent, excluding surfactant.

In yet another embodiment, the invention includes an aqueous composition for cleaning and neutralizing an acidic finish of a surface. The composition includes a surfactant and a buffering agent comprising a weak base selected from the group consisting of triethanolamine, ammonia, sodium tetraborate, sodium citrate, sodium carbonate, sodium bicarbonate, and mixtures thereof. The buffering agent may include an acid dissociation constant of from about 6.4 to about 10.3. The buffering agent may include triethanolamine. The weak base may be partially neutralized. The buffering agent may comprise about 3.3 volume percent of the composition without surfactant. The buffering agent may comprise from about 0.1 to about 1.0 volume percent of the composition without surfactant. The surfactant may include from about 0.1 to about 1.0 volume percent of the composition without buffering agent. The composition may also include an ingredient selected from the group consisting of defoamers, foaming agents, odor-controlling agents, softening agents, dispersants, chelating agents, bonding agents and mixtures thereof.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

DETAILED DESCRIPTION OF THE INVENTION

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, and so forth does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

In one embodiment, the present invention includes a new use of an aqueous composition including a surfactant, a buffering agent, and a pH greater than the pH of an acidic finish. The new use of the present embodiment includes the steps of applying the aqueous composition to a surface including an acidic finish, etching the surface, and removing the aqueous composition from the surface.

In another embodiment, the present invention is a method for cleaning and neutralizing an acidic finish of a surface using an aqueous composition. The aqueous composition of this embodiment includes a surfactant, a buffering agent, and a pH greater than a pH of the acidic finish.

In yet another embodiment, the present invention includes an aqueous composition for cleaning and neutralizing an acidic finish of a surface. The aqueous composition of the present embodiment includes a surfactant and a buffering agent comprising a weak base selected from the group consisting of triethanolamine, ammonia, sodium tetraborate, sodium citrate, sodium carbonate, sodium bicarbonate, and combinations thereof.

The composition of any of the embodiments includes a surfactant. It is theorized that the surfactant may play a role in the cleaning of the existing finish. However, the surfactant may play other roles, and therefore the cleaning theory of surfactants is not intended to be limiting to the invention. For example, surfactants may also increase the wetting or spreading capabilities of the composition. If the composition is applied to the surface using a spraying or a spritzing technique, the spraying or spritzing may form the composition into droplets. A surfactant may decrease the tendency of the composition to remain in droplet form after contacting the surface. Decreasing the tendency of the composition to remain in droplet form may increase the surface area that the same number of droplets freely covers, thus increasing the wetting capability of the composition. These possible functions of the surfactant are not meant to be limiting to the scope of this invention.

Surfactants commonly exist in three classes, namely ionic (anionic and cationic), nonionic, and zwitterionic. In any embodiment, the surfactant may be ionic, nonionic or zwitterionic. A combination of surfactants may be used, including surfactants from different classes, or surfactants within the same class.

Non-limiting examples of nonionic surfactants that may be used include surfactants with the structure represented by the following structure:

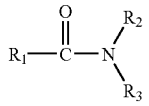

where $R_1$ may be hydrocarbyl groups such as, but not limited to, alkyl, cycloalkyl, substituted cycloalkyl, alkenyl, cycloalkenyl, substituted cycloalkenyl, aryl, allyl, substituted aryl, aralkyl, alkaryl, and alkynyl groups. These hydrocarbyl groups may contain heteroatoms such as, but not limited to, nitrogen, oxygen, silicon, sulfur, and phosphorus atoms. $R_2$ and $R_3$ may be the same or different. $R_2$ and $R_3$ may be hydrogen or hydroxyl groups. Non-limiting examples of non-ionic surfactants with the structure above include fatty diethanolamide and coconut diethanolamide.

Ionic surfactants of the present invention may include any known in the art. In one embodiment, an ionic surfactant has the following structure:

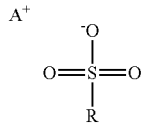

where $A^+$ can be any cation such as, for example, $Li^+$, $Na^+$ and $K^+$. R may be hydrocarbyl groups such as, but not limited to, alkyl, cycloalkyl, substituted cycloalkyl, alkenyl, cycloalkenyl, substituted cycloalkenyl, aryl, allyl, substituted aryl, aralkyl, alkaryl, and alkynyl groups. These hydrocarbyl groups may contain heteroatoms such as, but not limited to, nitrogen, oxygen, silicon, sulfur, and phosphorus atoms. One example of surfactants within this embodiment includes sodium alkane sulfonate such as sodium ethane sulfonate.

In another embodiment, an ionic surfactant has the following structure:

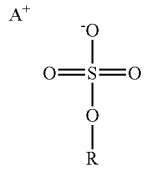

where $A^+$ and R are defined as above. R may also include unsaturation. Some non-limiting examples of ionic surfactants within this embodiment include sodium lauryl sulfate and sodium methyl-2-sulfolaurate. R may also include anions such as, for example, alcoholates, carboxylates, sulfonates, and the like. If R includes an anion, a second $A^+$ may be present, and may be the same as or different than any other $A^+$, so long as it includes a cation. One non-limiting example of an ionic surfactant in accordance with this embodiment includes disodium 2-sulfolaurate.

Surfactants are available under various tradenames, and can be formulated for various purposes. In one embodiment, the composition includes a surfactant sold under the tradename Flexiclean HWCC (available from Innovative Chemical. Technologies, Inc., Cartersville, Ga.). One skilled in the art will recognize that there are other possible suitable surfactants. The composition may include from about 0.1 to about 1.0 percent by volume surfactant, excluding the buffering agent.

In any of the embodiments, the composition also includes a buffering agent. Without limiting the invention, it is theorized that the buffering agent neutralizes the acidity of the existing finish, thus raising the pH of the existing finish to a level at which a new finish may be applied without "sliming." In one embodiment, the buffering agent includes a partially or non-neutralized base. Any base known in the art may be used, preferably a weak base. Non-limiting examples of weak bases include sodium carbonate, sodium bicarbonate, ammonia, sodium tetraborate, triethanolamine, and sodium citrate. In one embodiment, the base comprises a $pK_A$ (acid association constant) that is about equal to the desired pH of the composition. Table 1 lists the $pK_A$ of each base listed. It is known in the art that the base composition has the strongest buffering capacity when the pH of the composition matches the listed $pK_A$ of the base. A preferred base is triethanolamine, which has a $pK_A$ of about 7.8. Triethanolamine provides a buffering agent with a pH that is sufficiently close to neutral without being acidic.

TABLE 1

| Base | Sodium Carbonate | Sodium Bicarbonate | Ammonia | Sodium Tetraborate | Triethanolamine | Sodium Citrate |
|---|---|---|---|---|---|---|
| $pK_A$ | 10.3/6.4 | 10.3/6.4 | 9.2 | 9.2 | 7.8 | 6.4 |

The pH of the composition may be adjusted to the desired pH of the composition using well-known adjusting techniques. One well-known pH adjusting technique includes the addition of a strong base, such as sodium hydroxide, to raise the pH, or the addition of a strong acid, such as hydrochloric acid, to lower the pH. It should be noted that a $pK_A$ above about 11 may lead to discoloration if accidentally applied to bare wood. Accordingly, it is noted that triethanolamine is typically a safe base to use, with respect to sufficient buffer strength and the ability to avoid undesirable discoloration.

In this embodiment, the pH of the composition may be adjusted using a weak acid or a weak base. Adjustments to the pH of the composition are known, and one skilled in the art would be able to calculate the required adjustment. In one embodiment, the surface to be treated with the composition includes an acidic finish, and the buffering agent used in the composition is triethanolamine. The pH may be adjusted to a predetermined level using a weak acid such as, for example, adipic acid.

The buffering agent may include a plurality of partially or non-neutralized weak bases. For example, the bases may include at least two bases selected from triethanolamine, ammonia, sodium tetraborate, sodium citrate, sodium carbonate, and sodium bicarbonate. In one embodiment, the composition includes buffering agents which include both ammonia and triethanolamine. One skilled in the art would recognize that there are plethoric potential compositions available from the specified list of bases coupled with the potential strong and/or weak acids or bases used to adjust the pH to within the desired range.

The composition may include from about 0.1 to about 1.0 percent by volume buffering agent, excluding the surfactant. In another embodiment, the composition includes less than about 0.1 percent by volume buffering agent, excluding the surfactant. Without limiting the invention, however, it is theorized that by including less than about 0.1 percent by volume buffering agent, excluding surfactant, may reduce the buffering capacity of the composition, resulting in ineffective neutralization of the existing finish. In another embodiment, the composition includes more than about 1.0 percent by volume buffering agent, excluding surfactant. Without limiting the invention, however, it is theorized that by including more than about 1.0 percent by volume buffering agent, excluding surfactant, may create a residue on the surface, and result in waste.

Compositions with more than about 1.0 percent by volume of buffering agent, excluding surfactant or less than about 0.1 percent by volume of buffering agent, excluding surfactant may, however, be used. One skilled in the art would recognize situations in which higher or lower concentrations of buffering would be useful in the present invention. Nevertheless, it is within the scope of this invention that the composition may include greater than about 1.0 percent by volume of buffering agent, excluding surfactant.

Concentrated formulations of the composition are within the scope of this invention. It is within the skill in the art to calculate the concentration formula for a desired useable product. In one embodiment, the concentration is formulated such that the concentrated formula is diluted about 4 times with water for the useable composition. In one embodiment, 250 mL of the concentrated formula are diluted to 1 L of useable composition. The concentrated formula may be formulated to be diluted from about 3 to about 33 times with water for the useable composition. In one embodiment, a concentrated formulation includes about 3.3 percent by volume of buffering agent, excluding the surfactant. One of skill in the art would appreciate that the concentration of buffering agent may be influenced by the nature or chemical structure of the buffering agent. The calculations of the concentration and dilution of the composition may thus be affected using techniques known by one of skill in the art. One of skill in the art could calculate the concentration of surfactant needed in the concentrated formula such that the dilution of the concentrated composition to make the usable composition would result in a useable composition with the volume percentages of surfactant and buffering agent within the ranges herein prescribed.

In the embodiments of the method of cleaning and neutralizing a finish, and the new use of the aqueous composition, the method and new use include the steps of applying the composition to a surface with an existing acidic finish, etching the surface, and removing the composition. In one particular embodiment, a tool or surface-working apparatus is used to etch the finish.

The composition may be applied to the existing finish by any means. One skilled in the art would appreciate that the composition may be applied by methods including but not limited to pouring, spritzing, spraying, brushing, rolling, and so forth. In one embodiment, the step of applying the composition to the surface includes the use of an apparatus. The apparatus may include, for example, a spray bottle, a spray canister, a surface-working apparatus that incorporates the composition, and so forth.

One skilled in the art would also recognize the amount of composition that may be applied to the surface. Generally, a sufficient amount of composition to cover the surface to be treated should be applied. The step of application of the composition may include spreading of the composition on the surface. The spreading may be performed by any method known in the art. An apparatus may be used to spread the composition on the surface. The application and spreading of the composition on the surface may be performed simultaneously, or using the same apparatus. The spreading may be performed passively. For example, the spreading may occur by applying sufficient composition to cover the surface intended to be covered. As another example, the wetting capabilities may be such that after application of the composition to the surface, the composition flows to cover the surface intended to be covered.

The step of etching the surface may take place passively or actively. Etching may occur as the composition remains on the surface. Etching may occur through some work done on the surface with the composition. In one embodiment a tool is used to etch the surface.

In an embodiment where a tool is used to etch the finish after the application of the finish, the tool may be used at any time after the application of the finish, but before the removal of the composition from the surface. Non-limiting examples of a tool that may be used include a surface-working apparatus with a scrubbing or etching pad, a floor sander, surface working apparatus, hand-held sander, hand-held scrubber, floor polisher, floor cleaner, or other device that works to etch the existing finish. In one embodiment, the tool scrubs the finish for soil and stains, catalyzes the neutralization of the finish, and etches the surface at the same time. Preferably, the existing finish is sufficiently etched to facilitate bonding of the new finish to be applied.

It is theorized, but not meant to be limiting, that the etching of the surface may create sites on the finish of the existing surface to which a new finish may bond. These sites may exist because the existing surface, which may have become acidic over time, is neutralized to within a pH range that is comparable to the pH of the new finish to be applied. It is believed, but not meant to be limiting, that the sites create a better environment for bonding between the existing and the new finishes, and hence stronger bonds between the two finishes. The rate of delamination between the two finishes may, then, be decreased by cleaning and etching the existing finish in accordance with the present invention.

The composition and optional etching may create a slurry on the surface of the existing finish. The slurry may include both the composition and a portion of the existing finish. In one embodiment, the etching removes at least a portion of the composition or slurry. In another embodiment, the composition or slurry may be removed by any technique known in the art. Such techniques may include, for example, soaking, wiping, aspirating, and so forth. In one embodiment, the step of removal may be passive removal such as by evaporation. Preferably, the entire existing finish is not completely removed; rather, the existing finish remains only sufficiently etched to facilitate bonding between the remaining existing finish and a newly applied finish.

In one embodiment, after the composition or slurry is removed from the existing surface, a new finish is applied to the remaining existing finish. The steps of applying the composition, optionally etching, and removing the composition or slurry may result in a cleaned and/or neutralized existing finish. The new finish may be applied to the cleaned and neutralized existing finish.

It is understood that the above-described preferred embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the specification discusses a buffering agent concentration level of from about 0.1 to 1.0 volume percent excluding surfactant, it is envisioned that the concentration level may be varied depending on the job to be accomplished. Specifically, it is envisioned that where the finish has a high acidity level, the buffering agent concentration level may be increased. Furthermore, when the finish has a low acidity level, the base concentration level may be decreased.

It is further noted that the described buffering agent concentration levels are for efficiency purposes. Buffering agent concentration levels below or above the recommended levels may still fulfill the desired purpose, however, additional time may be required and there may be additional waste and cost involved.

Additionally, although the specification discusses the mixture of an aqueous composition, such as water, with a surfactant and a base, it is envisioned that the composition may include other ingredients. For example, the composition may include defoamers, foaming agents, odor controlling agents, softening agents, dispersants, chelating agents, bonding agents, and so forth. One skilled in the art will recognize that any other type of ingredient may be included to obtain a further object, so long as the ingredients do not substantially interfere with the intended purpose of the proposed invention.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

In order to demonstrate the practice of the present invention, the following examples have been prepared. The examples should not, however, be viewed as limiting the scope of the invention. The claims will serve to define the invention.

EXAMPLES

Three solutions were prepared and tested. Solution 1 was an aqueous solution of 1 weight-percent sodium lauryl sulfate, and had a pH of 7.5. Solution 2 was an aqueous solution of 3 ounces of an alkaline cleaner for hard surfaces sold under the tradename of Hydra-Solv (available from HydraMaster, Mukilteo, Wash.) in water. Solution 2 had a pH of 11.7. Solution 3 was an aqueous solution of 0.8 volume percent triethanolamine and 0.6 weight-percent surfactant. The surfactant was Flexiclean HWCC (available from Innovative Chemical Technologies, Inc., Cartersville, Ga.). Solution 3 was adjusted to a pH of 8.9 with adipic acid.

The three solutions were then tested. A strip of oak wood was treated with a 4.5 weight-percent solution of oxalic acid to acidify the wood. The wood was allowed to dry. Separate areas of the wood were then treated with equal portions of solutions 1, 2, and 3. The wood was again allowed to dry, and then treated with an aqueous solution that included 20 weight-percent polyurethane. Observations were made concerning the finish. Solutions 1 and 2 resulted in a slimy precipitate forming on the wood. Solution 3 resulted in no formation of a slimy precipitate.

What is claimed is:

1. A new use of an aqueous composition for cleaning and neutralizing a surface comprising an acidic finish, the aqueous composition comprising a surfactant, a buffering agent comprising triethanolamine, said aqueous composition having a pH of from about 7 to about 9, wherein the new use consisting of:

applying the aqueous composition to a surface including an acidic finish; etching the surface; removing the aqueous composition from the surface; and applying a new finish to the etched surface.

2. The new use of claim 1, wherein the step of removing comprises evaporation.

3. The new use of claim 1, wherein the step of etching the surface comprises use of a surface-working apparatus.

4. The new use of claim 1, wherein the buffering agent comprises a weak base with about 7.8 as an acid dissociation constant.

5. The new use of claim 1, wherein the buffering agent comprises from about 0.1 to about 1.0 volume percent of the composition excluding surfactant.

6. The new use of claim 1, wherein the surfactant comprises from about 0.1 to about 1.0 volume percent of the composition excluding buffering agent.

* * * * *